United States Patent [19]

Maxwell

[11] 4,383,690

[45] May 17, 1983

[54] GOLF PUTTER

[76] Inventor: Thomas J. Maxwell, 43957 Harsdale Dr., Canton, Mich. 48187

[21] Appl. No.: 284,177

[22] Filed: Jul. 17, 1981

Related U.S. Application Data

[63] Continuation-in-part of Ser. No. 91,176, Nov. 5, 1979, Pat. No. 4,290,606.

[51] Int. Cl.[3] ..... A63B 69/36; A63B 53/04

[52] U.S. Cl. ..... 273/164; 273/168; 273/186 A; 273/175

[58] Field of Search ..... 273/168, 129 R, 129 K, 273/129 L, 167 D, 164, 178, 162 R, 162 E, 175, 186 A; D21/217, 218, 219

[56] References Cited

U.S. PATENT DOCUMENTS

| | | | |
|---|---|---|---|
| D. 182,485 | 4/1958 | Sprinkel | 273/164 X |
| 1,437,463 | 12/1922 | Boye | 273/175 X |
| 1,846,412 | 2/1932 | Weinberg | 273/129 W |
| 3,881,733 | 5/1975 | Csernits | 273/168 |
| 4,290,606 | 9/1981 | Maxwell | 273/128 R |

*Primary Examiner*—George J. Marlo
*Attorney, Agent, or Firm*—Don J. Flickinger

[57] ABSTRACT

A golf club includes a club head having two body members and a hosel. Each of the two body members has a planar striking face, and the two faces determine an angle of 90°. Each of the two body members also has a bath surface which is grooved to reduce weight. The hosel joins the body members near the vertex of the 90° angle. A club shaft is inserted into the hosel. Indicia are formed on the upper surfaces of each of the body members which are parallel to a bisector of the 90° degree cycle to aid in aligning the club with the golf ball and the cup into which the ball is to be putted. Tuned resonators are mounted on each of the body members opposite the point on each striking face where the striking faces are tangent to a golf ball touching both faces. The resonators produce audible sounds, which are a function of how the club head strikes a golf ball.

23 Claims, 6 Drawing Figures

FIG. 1
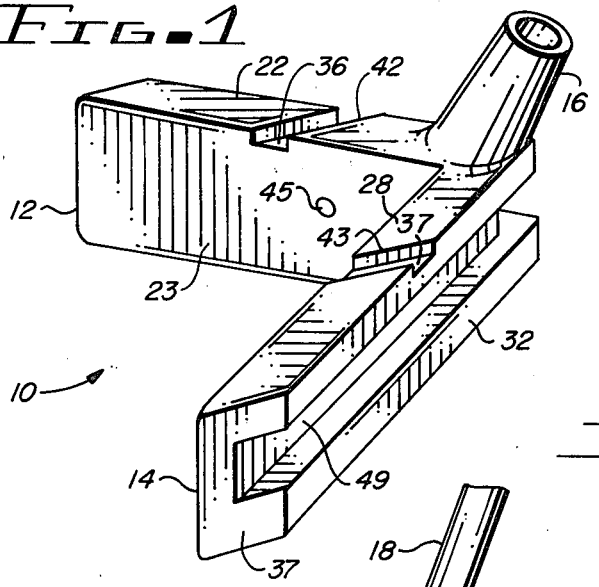
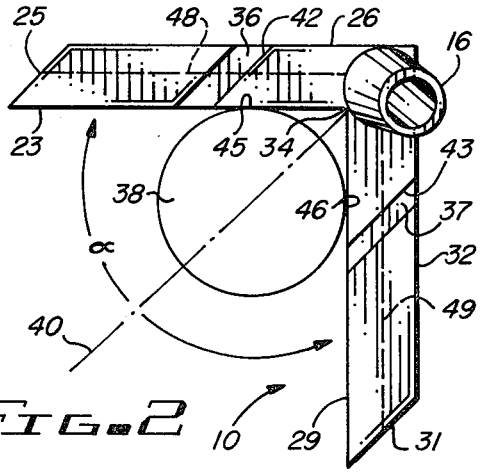
FIG. 2
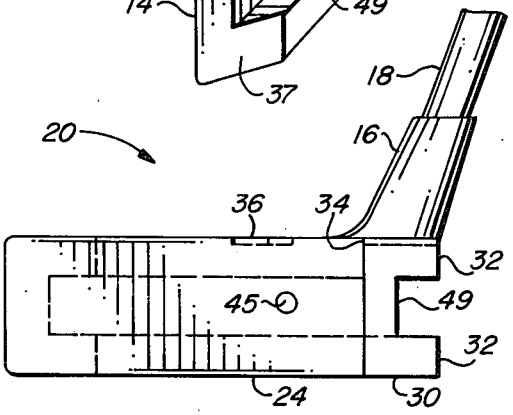
FIG. 3
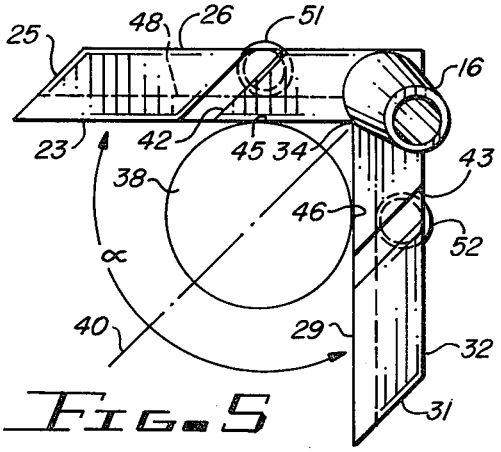
FIG. 5
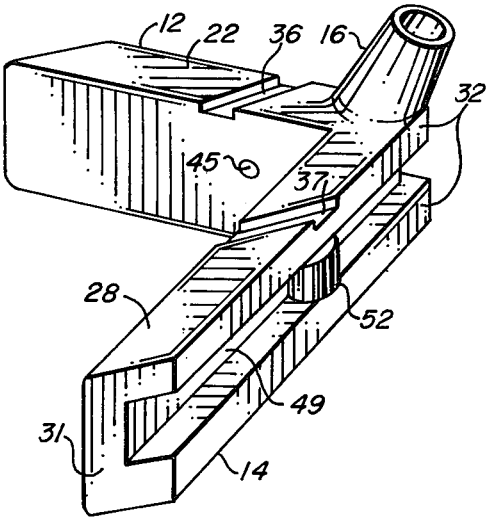
FIG. 4
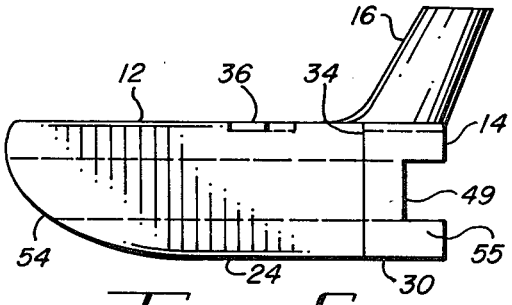
FIG. 6

GOLF PUTTER

CROSS REFERENCE TO RELATED APPLICATIONS

This application is a continuation-in-part of application Ser. No. 06/091,176, filed Nov. 5, 1979, now U.S. Pat. No. 4,290,606 entitled Nonpredictable Game Projectile, by Thomas J. Maxwell, the inventor of this application.

FIELD OF INVENTION

This invention relates to golf clubs, and more particularly to a putter, the club head of which is provided with two body members, the striking faces of which are substantially at 90° to one another.

DESCRIPTION OF THE PRIOR ART

Golf is a very popular game, and putting is a very important part of the game, or a game within a game. Hitting a golf ball with a putter so that the ball falls into the cup on an undulating surface, the texture of which is not always constant, is an act that even professional golfers do not perform consistently.

The rules of golf concerning the form and make of clubs provides that "The club shall have only one face designed for striking the ball, except that a putter may have two faces if the lift of both faces is substantially the same and does not exceed ten degrees. Club faces shall not embody any degree of concavity on the hitting surface."

Because of the difficulty in consistently putting well, putters are almost as individual as a necktie. Most putters have a single striking face of almost every conceivable size and shape with various distributions of mass and weight. Some putters have more than one striking face and a few are designed to produce a unique identifiable sound when the putter properly strikes a golf ball.

Putting is still, for most golfers, that part of their game in which the hope of reducing their handicaps by a stroke or two always appears to be tantalizingly in reach, but which few golfers find attainable with presently available putters.

Prior Art Statement

The following references are submitted under the provision of 37 CFR 1.97(*b*):

| | |
|---|---|
| U.S. Pat. No. 3,042,405 | Solheim; |
| U.S. Pat. No. 3,061,310 | Giza; |
| U.S. Pat. No. 3,194,564 | Swan; |
| U.S. Pat. No. 3,387,844 | Shippee; |
| U.S. Pat. No. 3,556,532 | Balmer; |
| U.S. Pat. No. 3,881,733 | Csernits; |
| U.S. Pat. No. 4,253,667 | Clark et al; |
| British Pat. No. 10,497 | Marriott et al. |

Solheim, U.S. Pat. No. 3,042,405, discloses a putter having one or two striking faces on opposite sides of the club head. When the golfer using the club hits the ball so that the proper point of the face of the club hits the ball, the club head rings with a clear note.

Giza, U.S. Pat. No. 3,061,310, teaches a putter having a resilient striking face that emits a bell-like tone when a golf ball is struck by it.

Swan, U.S. Pat. No. 3,194,564, discloses a practice putter which is provided with a notch 27 useful in lining up the club head with a golf ball in the address position. The club head has a pair of apertures in which a pair of pins may be removably positioned. When the pins are positioned in the apertures, unless contact and follow-through of a stroke are conducted properly, one or the other of the pins will contact the ball.

Shippee, U.S. Pat. No. 3,387,844, has a golf club which could be a putter, and which includes a hermetic percussion chamber plenum which produces a pleasantly mellow reverberating bong when the club properly strikes a golf ball.

Ballmer, U.S. Pat. No. 3,556,532, discloses a club head known as a "wood" which is made of plastic. The club head is provided with cavities so that the club head of Ballmer, when it strikes a golf ball, produces a sound similar to that provided by a "wood" actually made of wood.

Csernits, U.S. Pat. No. 3,881,733, discloses a multi-faced golf club putter. Csernits' club has a rectangular head, two of the surfaces of which provide a flat rectangular vertical putting face. A third face has a central vertical arcuately cutaway portion with vertical tangent surfaces extending outwardly and angularly therefrom, within which cut-away portion the ball may be positioned as it is struck by the club head.

Clark et al, U.S. Pat. No. 4,253,667, teaches a golf ball putter having two striking faces on opposite sides of the club head.

Marriott, et al, British Pat. No. 10,497, discloses a triangular shaped putting head with each side of the triangular head being a striking face.

SUMMARY OF THE INVENTION

The present invention provides an improved putter having a head having two blades, or body members, and a hosel, which are integrally joined together. Each of the body members has a planar striking face, which striking faces determine an angle of substantially 90°. The hosel is located near the vertex of the angle and the club shaft is inserted into the hosel. Alignment indicia are positioned on the top surfaces of the body members. The indicia are parallel to each other and are substantially parallel to the bisector of the angle formed by the striking faces of the two body members. Each striking face has a sweet spot, the point, or small area, which is substantially tangent to the surface of a golf ball when the ball is in contact with the striking faces of the body members. Tuned resonators are located on each body member substantially opposite the sweet spot to produce audible tones indicative of the manner in which the club faces strike the ball.

It is therefore an object of this invention to provide an improved putter.

It is another object of this invention to provide an improved putter, the head of which has two striking faces substantially perpendicular to each other.

It is still another object of this invention to provide an improved putter which has two striking faces which are substantially at right angles to each other and which are provided with tuned resonators, which resonators produce audible sounds to aid a player in determining when a golf ball is properly struck by the putter of this invention.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the now concepts of the disclosure, and in which:

FIG. 1 is a perspective view of one embodiment of a putter head of this invention;

FIG. 2 is a plan view of the putter head of FIG. 1;

FIG. 3 is a side elevation of the putter of FIG. 1;

FIG. 4 is a perspective view of another embodiment of the putter head of this invention;

FIG. 5 is a plan view of the putter head of FIG. 4; and

FIG. 6 is a side elevation similar to FIG. 3, illustrating a third embodiment of the putter head of this invention.

DESCRIPTION OF THE PREFERRED EMBODIMENT

In FIG. 1, club head 10 of a golf club for use in putting, or a putter, is provided with two body members, or blades, 12 and 14. Club head 10 is also provided with a hosel 16, a socket into which club shaft 18 is inserted. In FIG. 3, only the lower portion of club shaft 18 of putter 20 is illustrated. Body member, or blade, 12 has a top surface 22, a striking face 23, a bottom surface, or sole 24, a toe, or end portion 25, and a back surface 26. Similarly, a body member, or blade, 14 has a top surface 28, a striking face 29, a bottom surface or sole 30, a toe, or end portion, 31, and a back surface 32. In the embodiments illustrated, the striking faces 23, 29, top surfaces 22, 28, the soles 24, 30, and back surfaces 26, 32 are each substantially planar, as are toes, or end portions 25, 31 of the embodiments illustrated in FIGS. 1-5.

Body members 12 and 14 and hosel 16 are preferably formed integrally, and the striking faces 23, 29 determine an angle $\alpha$ of substantially 90°, or faces 23, 29 are substantially at right angles to each other. Hosel 16 joins members 12 and 14 adjacent the vertex 34 of the angle $\alpha$ which is, as stated above, determined by striking faces 23, 29, as is best illustrated in FIGS., 2 and 5 for example.

Alignment indicia, or grooves, 36, 37 are formed on top surfaces 22, 28 of members 12 and 14 to aid in lining up club head 10 with golf ball 38. Grooves 36, 37 are made substantially parallel to bisector 40 of angle $\alpha$ as is illustrated in FIGS. 2 and 5 and are positioned so that the inner edges 42, 43 of grooves 37 and 37 are substantially tangent to the surface of golf ball 38, or are substantially aligned with the perimeter of ball 38, when golf ball 38 is positioned in contact with both of the striking faces 23, 29 of body members 12 and 14, as is illustrated in FIGS. 2 and 5.

As best seen in FIGS. 2 and 5, the substantially spherical surface of golf ball 38, when golf ball 38 is in contact with both striking surfaces 23, 29 of blades 12 and 14, contacts, or is tangent to, small areas, or points 45, 46, on surfaces 23 and 26, which points or areas are sometimes referred to as "sweet spots". Points 45 and 46 are called sweet spots because the maximum transfer of momentum from club head 10 to ball 38 occurs if ball 38 and club head 10 contact each other at these points while a golfer is swinging club 20 with club head 10 oriented and moving in such a manner that bisector 40 substantially continuously lies in a given plane of movement of club 20 and substantially bisects ball 38.

As mentioned above, top surfaces 22, 28 and soles 24, 30 are substantially planar and are, in the preferred embodiment substantially parallel to each other. Similarly striking faces 23, 29 and back surfaces 29, 63 or members 12 and 14 are substantially planar and parallel to each other. In the preferred embodiment, grooves 48, 49, which have a rectangular cross-sectional area of substantially equal size, are cut, or or formed, in the back surfaces 26, 32 of body members 12 and 14 to reduce the weight of club head 10, while maintaining members 12 and 14 substantially as rigid as if grooves 48, 49 had not been formed.

To assist a golfer in using club 20, in the embodiment illustrated in FIGS. 4 and 5, tuned resonators 51, 52 are positioned, or mounted, on body members 12 and 14 substantially opposite the points, or areas, of contacts 45, 46. Or, the centers of resonators 51, 52 substantially lie on a line perpendicular to faces 23, 29 at points 45, 46. In the embodiment illustrated in FIGS. 4 and 5, resonators 51 and 52 are positioned substantially within grooves 48, 49 of the members 12 and 14 substantially directly opposite the points of contact 45, 46 of striking faces 23, 29. As a result of the location of resonators 51, 52, a maximum amount of energy is transferred to the resonators 51, 52 when club head 10 correctly strikes, or impacts, a golf ball 38. The energy so transferred to resonators 51 and 52 causes them to oscillate at their designed audio frequencies.

Resonators 51 and 52 are preferably tuned to the same frequency so that when club head 10 correctly strikes the golf ball 38, resonators 51 and 52 produce a clear note corresponding to the frequency at which resonators 51 and 52 are designed to vibrate or oscillate. Alternatively, resonators 51 and 52 can be tuned to different frequencies which will assist a golfer in determining if he is hitting golf ball 38 properly, and if he is not, how the club 10 is striking ball 38. From this aural information, the golfer can improve his swing by eliminating any deficiencies in holdng and swinging putter 20 while putting. In FIG. 6, another embodiment of the improved putter of this invention is illustrated. Blade 12 and blade 14 are each provided with a rounded toe, or end portion, 54, 55, which provide a putter having a different weight distribution as compared with the putter club heads having rectangular shaped body members 12 and 14, as illustrated in FIGS. 1-5.

When putting with putter 20, the golfer addresses golf ball 38 so that the alignment indicia 36, 37 are positioned with the golf ball 38 between the inner edges 42, 43 of groove 36, 37. Club head 10 is moved, or swung, through an arc so that axis 40 lies in the plane of motion and substantially bisects ball 30, with the result that sweet spots 45, 46 essentially both contact the surface of ball 38 at the same time, or substantially simultaneously. As a result, ball 38 will roll in a direction substantially aligned with bisector, or axis 40. The angular relationship between blades 12 and 14 and the fact that the alignment grooves 36, 37 are aligned with, or are parallel to, axis 40, results in grooves 36, 37 being longer in the direction of movement of club head 10 parallel to axis 40. As a result, the grooves 36, 37 are more effective in aiding a golfer in properly positioning club head 10 so that it will cause ball 38 to roll in the desired direction toward the cup, and in causing golf ball 38 to essentially simultaneously contact points 45, 46.

In the embodiment illustrated in FIGS. 5 and 6, when ball 38 is struck by body members 12 and 14, some energy is imparted to resonators 51, 52 which will cause them to oscillate at an audible frequency. If both resonators 51 and 52 are tuned to the same frequency, then, when club head 10 properly strikes ball 38, a clear note at the frequency of the resonators will be produced. If the ball is not properly struck, the sounds produced will not be the same. The differences between the sound produced when golf ball 38 is properly struck or contacted by club head 10 and when it is not can be used by a golfer to selfdiagnose what he has done improperly in swinging the putter. Providing club head 10 with resonators which are tuned to different frequencies will provide more audible information to the golfer using the putter and thus assist his diagnosis as to how he is swinging putter 20 and striking ball 38, so the golfer can improve his swing and thus his putting.

A feature of club head 10 is that since the striking faces 23, 29 are at right angles to each other, when club 20 is swung so that axis 40 substantially lies in the plane of the swing, even if ball 38 does not strike points 45, 46 substantially simultaneously, ball 38 wll be propelled in a direction substantially parallel to axis 40. The reason for this is that golf ball 38 is highly elastic, so that the impact of ball 38 with striking surface 23, for example, is essentially elastic with the angle of incidence substantially equalling the angle of reflection. Ball 38 will then be reflected off of the striking face 23 toward striking face 29. Ball 38 will be reflected from face 29 at an angle such that it will move substantially parallel to axis 40, but the path will be displaced slightly toward member 14 under the circumstances postulated above. Thus, putter 20 is much more forgiving with respect to how the club strikes a golf ball than is the conventional putter with a single striking face.

It should be evident that various modifications can be made to the described embodiments without departing from the scope of the present invention.

What is claimed is:

1. A putter comprising a head having a hosel, and two body members; each body member having a substantially planar face, a toe, a back surface, and a top surface, the planar faces of said body members forming an angle of substantially 90°; each of the top surfaces being provided with alignment indicia which are substantially parallel to each other and to a bisector of the angle formed by the body members; and a shaft connected to the hosel.

2. A putter as defined in claim 1 in which the toe of each member is substantially rectangular.

3. A putter as defined in claim 1 in which the toe of each member is rounded.

4. A putter as defined in claim 1 in which a resonator is mounted on the back surface of each body member.

5. A putter as defined in claim 4 in which the resonators are mounted on the back surfaces of each body member substantially opposite the point of the striking face adapted to simultaneously contact a golf ball.

6. A putter as defined in claim 5 in which the resonators oscillate at substantially the same audio frequency.

7. A putter as defined in claim 5 in which the resonators oscillate at substantially different frequencies.

8. A golf club comprising a club head having a hosel and two body members joined together, each body member having a substantially planar striking face, a back surface, a top surface, a toe, a heel, a sole, and a groove in said back surface, said planar striking faces determining an angle of substantially 90°, said hosel being positioned near the vertex of the angle; and a shaft inserted into said hosel, each striking face having a sweet spot which is tangent to a golf ball in contact with each face.

9. A putter as defined in claim 8 in wich alignment indicia are formed in the top surfaces of the two body members.

10. A putter as defined in claim 9 in which the alignment indicia are substantially parallel to a bisector of said 90° angle.

11. A putter as defined in claim 8 in which the toe of each member is a substantially vertical rectangular surface.

12. A putter as defined in claim 8 in which the toe of each member is rounded.

13. A putter as defined in claim 8 in which a resonator is mounted in the groove of each body member.

14. A putter as defined in claim 13 in which each resonator is mounted in the groove of each body member substantially opposite the sweet spot of each striking face.

15. A putter as defined in claim 13 in which the resonators oscillate at substantially the same audio frequency.

16. A putter as defined in claim 13 in which the resonators oscillate at substantially different audio frequencies.

17. A putter comprising a head having two body members integrally joined, each body member having a substantially planar striking face, a back surface substantially parallel to said striking face, a groove in said back surface, a top surface, a toe, a heel, and a sole, said planar striking faces determining an angle of substantially 90°; a hosel integrally formed with said body members and joining said members substantially in the vicinity of the vertex of the angle formed by said planar striking faces; and each striking face having a sweet spot which substantially contacts the surface of a golf ball when the golf ball contacts both surfaces simultaneously.

18. A putter as defined in claim 17 in which alignment grooves are formed in the top surfaces of said body member.

19. A putter as defined in claim 18 in which the alignment grooves are substantially parallel to the bisector of the 90° angle and substantially aligned with the perimeter of a golf ball when said golf ball contacts both said sweet spots.

20. A putter as defined in claim 17 in which a resonator is mounted on the back surface of each body member.

21. A putter as defined in claim 20 in which each resonator is tuned to produce a sound having substantially the same frequency.

22. A putter as defined in claim 20 in which each resonator is tuned to produce a sound of substantially different frequency.

23. A putter as defined in claim 20 in which each resonator is mounted in the groove of a member substantially opposite the sweet spot of the member.

* * * * *